US005628805A

United States Patent [19]

Lif et al.

[11] Patent Number: 5,628,805

[45] Date of Patent: May 13, 1997

[54] ETHANOL FUEL AND THE USE OF AN IGNITION IMPROVER

[75] Inventors: Anna Lif, Skärhamn; Stig Svennberg, Stenungsungd, both of Sweden

[73] Assignee: Akzo Nobel nv, Arnhem, Netherlands

[21] Appl. No.: 600,971

[22] PCT Filed: Jul. 15, 1994

[86] PCT No.: PCT/EP94/02347

§ 371 Date: Feb. 20, 1996

§ 102(e) Date: Feb. 20, 1996

[87] PCT Pub. No.: WO95/05437

PCT Pub. Date: Feb. 23, 1995

[30] Foreign Application Priority Data

Aug. 19, 1993 [SE] Sweden ..... 9302680

[51] Int. Cl.[6] ..... C10L 1/18

[52] U.S. Cl. ..... 44/443; 44/451

[58] Field of Search ..... 44/451, 443; C10L 1/18

[56] References Cited

U.S. PATENT DOCUMENTS

| | | | |
|---|---|---|---|
| 4,298,352 | 11/1981 | Ake et al. . | |
| 4,333,739 | 6/1982 | Neves | 44/451 |
| 4,541,835 | 9/1985 | Norton et al. | 44/445 |
| 4,541,837 | 9/1985 | Norton et al. | 44/445 |
| 5,183,476 | 2/1993 | Carlsson et al. | 44/451 |

FOREIGN PATENT DOCUMENTS

| | | | |
|---|---|---|---|
| 0030429 | 6/1981 | European Pat. Off. | C10L 1/00 |
| 0403516 | 12/1990 | European Pat. Off. | C10L 1/02 |
| 3628504 | 3/1987 | Germany | C10L 1/18 |
| 1591398 | 6/1981 | United Kingdom | C10L 1/18 |
| 2143846 | 2/1985 | United Kingdom | C10L 1/02 |
| WO89/07637 | 8/1989 | WIPO | C10L 1/02 |

*Primary Examiner*—Jacqueline V. Howard

*Attorney, Agent, or Firm*—Ralph J. Mancini; Louis A. Morris

[57] ABSTRACT

The ignition of an aqueous ethanol fuel is essentially improved by using a water soluble adduct of a polyol having 3–10 hydroxyl groups and ethylene oxide and/or propylene oxide, the molecular weight of the adduct being 350–10,000. The fuel is in the form of a solution and contains 70–96% by weight of ethanol, 2–10% by weight of water and 0.5–20% by weight of the ignition improving adduct.

8 Claims, No Drawings

ETHANOL FUEL AND THE USE OF AN IGNITION IMPROVER

The present invention relates to an aqueous ethanol fuel which contains an adduct of a polyol having 3–10 hydroxyl groups and ethylene oxide and/or propylene oxide as an ignition improver.

Because of the high ignition temperature of ethanol, it is not possible to use pure ethanol as fuel in a conventional diesel engine. One way of igniting the ethanol fuel is to provide the diesel engine with spark plugs, but this necessitates extensive modifications to the engine construction. For conventional diesel engines, a so-called ignition improver, i.e. an agent which serves to lower the ignition temperature of the fuel, has been added to the ethanol. The predominant ignition improvers are alkyl nitrates, and the most used substance is 2-ethylhexyl nitrate, generally abbreviated EHN.

EHN, which has a rather strong and disagreeable odour, is toxic and can be hydrolysed to nitric acid and 2-ethylhexanol when stored for longer periods of time, especially at elevated temperature. The hydrolysis causes a marked lowering of the pH, implying a serious risk of corrosion. A further serious objection to EHN is that the substance contains nitrogen which may increase the emission of nitrogen oxides with the exhaust gases.

European Patent Application 403 516 discloses that the mentioned disadvantages of using EHN as an ignition improver can be eliminated if it is replaced by a water-soluble polyalkylene glycol compound containing 6–50 alkylene oxide units having 2–4 carbon atoms under the proviso that the molecular weight of the polyalkylene glycol compound is less than 2500.

European patent application 030 429 relates to fuel comprising a mixture of at least one alcohol having a molecular weight of less than 160 and at least one further organic compound, which can be a compound containing one or more oxygen atoms but no nitrogen atoms. In the working examples acetaldehyde is the only nitrogen-free ignition improving agent used in an ethanol fuel.

It is also known to add corrosion inhibitors and lubricants to fuel. German Patent Application A1, 3 628 504 describes a fuel mixture of hydrocarbons, an alcohol and a corrosion inhibitor in an amount of up to 5000 ppm. This inhibitor contains a surface active agent, i.e. block polymers of alkylene oxides.

British Patent Application A 2 143 846 discloses the use of 0.005–0.05% by weight of a polyalkylene glycol as a lubricity improver in a diesel fuel based on methanol and/or ethanol.

British Patent Application A 1 591 398 describes a methanol fuel containing at least 50% by weight of methanol and as an ignition improver a methanol-soluble polyether containing 4–400 oxyalkylene units derived from ethylene oxide and/or propylene oxide units, the oxyalkylene units being at least 40% by weight of the polyether.

It has now surprisingly been found that the ignition of an aqueous ethanol based fuel can be essentially improved if an water soluble adduct of a polyol, with 3–10, preferably 3–6 hydroxyl groups and ethylene oxide and/or propylene oxide with a molecular weight of from 350 to 10 000, preferably from 450 to 5 000, is used as an ignition improver. The adduct has at least 3 hydroxyl groups and tests have shown that its presence in an ethanol fuel essentially shortens the delay of ignition in comparison with the polyalkylene glycol compounds of European Patent Application 403 516, which contain 1 or 2 hydroxyl groups. Since the adduct containing only carbon, hydrogen and oxygen its combustion contributes no additional hazard to the environment.

An aqueous ethanol fuel according to the invention has the form of a solution and contains 70–96%, preferably 80–95% by weight of ethanol, 2–10%, preferably 3–6% by weight of water and 0.5–20%, preferably 2–10% by weight of the water-soluble adduct.

Preferred adducts are those which are encompassed by the formula $$R(O(A)_nH)_m \qquad (I)$$

in which R is a hydrocarbon group containing 0–3 functional groups selected from the group consisting of the ether, aldehyde and keto group and having 3–22, preferably 3–12 carbon atoms, A is ethyleneoxy and/or propyleneoxy, n is a number from 2–20, preferably from 3–10 and m is a number from 3 to 10, preferably from 3 to 6. The number of functional groups in R is preferably 0 or 1. The group $(A)_n$ are preferably ethyleneoxy units or a mixture of ethyleneoxy and propyleneoxy units, the number of ethyleneoxy units being at least 40%, preferably at least 70% of the total number of A groups. Most preferred A is ethylenoxy and the number of functional group in R is normally 0 or 1.

The adducts may be produced by alkoxylation of a polyol with 3–10 hydroxyl groups like glycerol, trimetylolpropan, di(trimetylolpropan), pentaerytritol, saccharides such as glucose and saccharose, and reduced saccharides, such as sorbitol, in one or more steps with ethylene oxide, propylene oxide or both ethylene oxide and propylene oxide. If the polyol is reacted with both ethylene oxide and propylene oxide they may be reacted randomly or in two or more blocks. Ethylene oxide adducts based on the above mentioned polyols and with a molecular weight of from 500–2000 are excellent ignition improvers for an aqueous ethanol fuel. Preferably the adducts are essentially free from ashes, e.g. lower than 0.2% by weight in order to minimize deposits in the cylinders and the exhaust catalytic converter. Normally the adducts contain ashes from the metal compound used as catalyst in the production and these metal compounds may be removed by ionic exchange or by precipitation followed by filtration. Another method to obtain ash-free polyalkylene glycols is to use organic ash-free catalysts in the production.

Many adducts in accordance with the invention are soluble in ethanol containing minor amounts of water at temperatures down to at least −37° C. The aqueous ethanol fuels containing those adducts can be used at this temperature and they exhibit also essentially improved ignition when the inlet air is preheated. The amount of the adduct may vary within wide limits depending on the temperature conditions under which the fuel is to be used, and the construction of the diesel engine. A diesel fuel adapted to a modern diesel engine having a high compression ratio and/or preheating of the inlet air normally contains from 0.5 to 10%, preferably from 1–8% by weight of the adduct, while other diesel engines may require higher amounts.

Besides ethanol, water and the adduct, the fuel according to the invention may also contain a number of conventional additives, such as corrosion inhibitors, lubrication-improving agents and denaturants.

To further illustrate the present invention, the following Examples are given.

EXAMPLES 1–8

Different ethanol fuels were tested in an one-cylinder supercharged laboratory diesel engine. The trials were performed at an engine speed of 40 rps, a compression of 20:1 and a load of about 15%. The inlet air was preheated to 160°, 180° and 200° C. The delay in the ignition of the fuel was determined as the time from the injection of the fuel (defined as the time when the injection valve needle had been lifted ⅕ of the whole lift) to the start of the combustion (defined as the time when the speed of the energy release had reached 5 kJ/kg °CA).

The ethanol fuels tested contained three different levels of ignition improvers. The compositions of the fuels were as follows.

| | Components, % by weight | | |
|---|---|---|---|
| Diesel fuel | Ethanol | Water | Ignition improver |
| I | 94.0 | 5.0 | 1.0 |
| II | 91.3 | 4.8 | 3.9 |
| III | 88.8 | 4.7 | 6.5 |

The tested ignition improvers according to the invention were as follows.

Example 1 Glycerol ethoxylate, molecular weight 600
Example 2 Glycerol ethoxylate, molecular weight 880
Example 3 Trimetylolpropane ethoxylate, molecular weight 400
Example 4 Trimetylolpropane ethoxylate, molecular weight 600
Example 5 Trimetylolpropane ethoxylate, molecular weight 930
Example 6 Di(trimetylolpropane) ethoxylate, molecular weight 1300
Example 7 Sorbitol ethoxylate, molecular weight 980
Example 8 Pentaerytritol ethoxylate, molecular weight 800
Comparison Polyetylenglycol, molecular weight 600

The following results were obtained.

| | Ignition delay, milliseconds | | | | | | | | |
|---|---|---|---|---|---|---|---|---|---|
| Temp. | 160° C. | | | 180° C. | | | 200° C. | | |
| Fuel | I | II | III | I | II | III | I | II | III |
| Example | | | | | | | | | |
| 1 | 0.85 | 0.62 | 0.34 | 0.66 | 0.46 | 0.25 | 0.42 | 0.34 | 0.23 |
| 2 | 0.82 | 0.63 | 0.36 | 0.59 | 0.41 | 0.28 | 0.43 | 0.28 | 0.24 |
| 3 | 0.84 | 0.64 | 0.45 | 0.59 | 0.41 | 0.33 | 0.43 | 0.30 | 0.26 |
| 4 | 0.82 | 0.66 | 0.43 | 0.62 | 0.42 | 0.30 | 0.47 | 0.32 | 0.26 |
| 5 | 0.88 | 0.63 | 0.34 | 0.65 | 0.42 | 0.26 | 0.44 | 0.32 | 0.24 |
| 6 | 0.84 | 0.61 | 0.35 | 0.61 | 0.40 | 0.28 | 0.42 | 0.32 | 0.23 |
| 7 | 0.85 | 0.71 | 0.39 | 0.65 | 0.44 | 0.27 | 0.43 | 0.31 | 0.23 |
| 8 | 0.90 | 0.71 | 0.39 | 0.62 | 0.46 | 0.29 | 0.41 | 0.29 | 0.23 |
| Control | 0.95 | 0.67 | 0.42 | 0.66 | 0.47 | 0.35 | 0.47 | 0.34 | 0.26 |

From the results it is evident that the adducts in accordance with the invention are superior to the comparison compound as an ignition improver in aqueous ethanol diesel fuels. The average value for all tests are as follows.

| Examples | Ignition delay, millisecond |
|---|---|
| 1 | 0.463 |
| 2 | 0.449 |
| 3 | 0.472 |
| 4 | 0.478 |
| 5 | 0.465 |
| 6 | 0.450 |
| 7 | 0.476 |
| 8 | 0.478 |
| Control | 0.510 |

We claim:

1. An aqueous ethanol fuel in the form of a solution which comprises 70–96% by weight of ethanol, 2–10% by weight of water and 0.5–20% by weight of an water soluble adduct of a polyol having 3–10hydroxyl groups and ethylene oxide and/or propylene oxide, wherein the molecular weight of the adduct is 350 to 10,000 .

2. Fuel in accordance with claim 1, wherein the adduct has the formula $$R(O(A)_nH)_m$$

in which R is a hydrocarbon group containing 0–3 functional groups selected from the group consisting of the ether, aldehyde and keto group, and having 3–22carbon atoms, A is ethyleneoxy and/or propyleneoxy, n is a number from 2–20and m is a number from 3 to 10.

3. Fuel in accordance with claim 2, wherein the number of functional groups is 0.

4. Fuel in accordance with claim 2, wherein the number of functional groups is 1.

5. Fuel in accordance with claim 1, wherein A is ethyleneoxy.

6. The ethanol fuel of claim 1 which comprises 80–95% by weight ethanol, 3–6% by weight of water, 2–15% by weight of a water-soluble adduct of a polyol having 3–6 hydroxyl groups and ethylene oxide and/or propylene oxide, wherein the molecular weight of the adduct is between 450–5,000.

7. The ethanol fuel of claim 2 wherein R has 3–12 carbon atoms, n is a number of from 3–10 and m is a number of from 3–6.

8. A method for improving the ignition of an aqueous ethanol based fuel which comprises adding to said fuel 2–10% by weight of the water soluble adduct of claim 2.

* * * * *